US007635233B1

(12) United States Patent
Coyer

(10) Patent No.: US 7,635,233 B1
(45) Date of Patent: Dec. 22, 2009

(54) RETRACTABLE MARKING DEVICE

(76) Inventor: Leo P. Coyer, 2124 Palmer Rd., Three Rivers, MA (US) 01080

( * ) Notice: Subject to any disclaimer, the term of this patent is extended or adjusted under 35 U.S.C. 154(b) by 651 days.

(21) Appl. No.: 11/307,993

(22) Filed: Mar. 2, 2006

Related U.S. Application Data

(60) Provisional application No. 60/657,916, filed on Mar. 2, 2005.

(51) Int. Cl.
*B43K 23/02* (2006.01)

(52) U.S. Cl. ..... 401/131; 401/195; 401/52; 224/162

(58) Field of Classification Search ..... 401/131, 401/195, 50–52, 6, 9; 144/28.1–28.9; 33/760, 33/668, 767, 768, 770; 30/138
See application file for complete search history.

(56) References Cited

U.S. PATENT DOCUMENTS

| | | | | |
|---|---|---|---|---|
| 245,257 | A | 8/1881 | Wright | |
| 264,593 | A * | 9/1882 | Wright | 401/131 |
| 1,577,272 | A * | 3/1926 | Treadaway | 401/131 |
| 2,793,617 | A | 5/1957 | Palmer | |
| 4,194,703 | A * | 3/1980 | Roe | 242/381.3 |
| 4,697,349 | A * | 10/1987 | Lee | 33/27.03 |
| 4,766,673 | A * | 8/1988 | Bolson | 33/760 |
| 4,898,532 | A * | 2/1990 | Bercik | 431/253 |
| 4,951,856 | A | 8/1990 | Horgan | |
| 5,379,524 | A * | 1/1995 | Dawson | 33/768 |
| 5,947,623 | A | 9/1999 | Smith | |
| 6,065,892 | A | 5/2000 | Smith | |
| 6,190,078 | B1 | 2/2001 | Smith | |
| 6,318,921 | B1 | 11/2001 | Craine | |
| 6,418,413 | B2 | 7/2002 | DeMarcken et al. | |
| 6,450,718 | B1 | 9/2002 | Spruill | |
| 6,499,899 | B2 * | 12/2002 | Sawyer | 401/131 |
| D469,122 | S | 1/2003 | Rosenbaum | |
| 6,575,649 | B1 | 6/2003 | Kuan-Hsiung et al. | |
| 6,840,414 | B2 * | 1/2005 | Ziegler | 401/131 |
| 7,195,413 | B2 * | 3/2007 | Kremizis | 401/131 |
| 7,270,289 | B2 * | 9/2007 | Kish | 401/131 |
| 2002/0005163 | A1 | 1/2002 | Sawyer | |
| 2002/0011006 | A1 * | 1/2002 | Smith | 33/668 |
| 2003/0175066 | A1 | 9/2003 | Steckler | |

* cited by examiner

*Primary Examiner*—David J Walczak
*Assistant Examiner*—Keegan Gumbs
(74) *Attorney, Agent, or Firm*—Doherty Wallace Pillsbury & Murphy, P.C.

(57) ABSTRACT

A retractable marking device comprising a casing holding a retractor, an engagement element, a fastener, and a barrel. The engagement element holds marking instruments having a variety of diameters, wherein the marking instruments may comprise, for example, pencils, pens, chalk, and the like. Additionally, the engagement element is secured to the retractor, wherein the retractor comprises a coil retractably wound around a reel, such that the engagement element can be repeatedly extended from and retracted to the casing. The fastener secures the device to a user's garb or working paraphernalia for ready accessibility. Furthermore, the barrel holds a sharpener, wherein the sharpener sharpens the marking instrument. Additionally, depending upon the particular embodiment, the retractable marking device may sharpen the marking instrument either manually or mechanically.

13 Claims, 4 Drawing Sheets

RETRACTABLE MARKING DEVICE

CROSS REFERENCE TO RELATED APPLICATIONS

This application claims the benefit of U.S. Provisional Application No. 60/657,916 filed on Mar. 2, 2005.

BACKGROUND OF THE INVENTION

1. Field of the Invention

The present invention generally relates to a marking device. More specifically, the present invention relates to a retractable marking device, which is attachable to a user's garb or working paraphernalia.

2. Background of the Invention.

Most people have experienced the inconvenience of requiring a marking instrument for a particular task and finding their marking instrument is not at hand. Such inconvenience is particularly acute for people whose jobs require them to write, mark and/or erase frequently, but who also are required to have free use of their hands at other times for non-writing tasks. These people include tradespeople, such as carpenters and contractors, that need a writing or marking instrument to mark wood and other building materials, make notes on plans, and perform other writing tasks on the jobsite. Such tradespeople also must perform non-writing tasks, such as building and assisting in construction.

To insure that a marking instrument is at hand, people often place the instrument in their clothing, such as in a pocket, or place the marking instrument behind an ear. This solution is less than ideal, as tradespeople may not have the proper clothing to store a marking instrument and those that put them behind their ear may find that they fall out when the user changes position to perform physical activities. Additionally, those that wear glasses or use large marking instruments may find that they do not fit behind their ears.

One potential solution is to place a writing/marking instrument on or near the writing surface or work station. However, marking instruments stored in this fashion may be removed by other workers from the work station or writing surface, or the user may move to other locations at the jobsite which are distant from the work station containing the marking instrument.

None of the aforementioned solutions are ideal for the tradesperson. Therefore, there exists a need for a retractable marking device that may be attached to the tradesperson's garb or working paraphernalia, e.g., the tradesperson's belt, pocket, tool belt, tool case, briefcase, and the like. Such a device will ensure that the tradesperson always has a marking instrument on their person that may be retracted merely by releasing their grip on the instrument. The ideal device is also secure, convenient and easy to use.

Additionally, there exists a need for a retractable marking device in which the marking instrument's writing end and, wherein applicable, erasing end are both exposed and available for use by a tradesperson. This is particularly important for the tradesperson working with a pencil and, for example, writing on a plan.

There also exists a need for a retractable marking device that includes a sharpener for enhancing the usability of the marking instrument when the need arises. The sharpener preferably would be removable so that when it dulls and becomes less effective, it may be replaced.

SUMMARY OF THE INVENTION

The above-discussed and other drawbacks and deficiencies of the prior art are overcome or alleviated by a retractable marking device comprising a casing holding a retractor, an engagement element, a fastener, and a barrel. The engagement element holds marking instruments having a variety of diameters, wherein the marking instruments may comprise, for example, pencils, pens, chalk, and the like. Additionally, the engagement element is secured to the retractor, wherein the retractor comprises a coil retractably wound around a reel, such that the engagement element can be repeatedly extended from and retracted to the casing. The fastener secures the device to a user's garb or working paraphernalia for ready accessibility. Furthermore, the barrel holds a sharpener, whereby the sharpener sharpens the marking instrument. Sharpening of the marking instrument may occur either via manual or mechanical means.

DETAILED DESCRIPTION OF THE INVENTION

Figure 1:
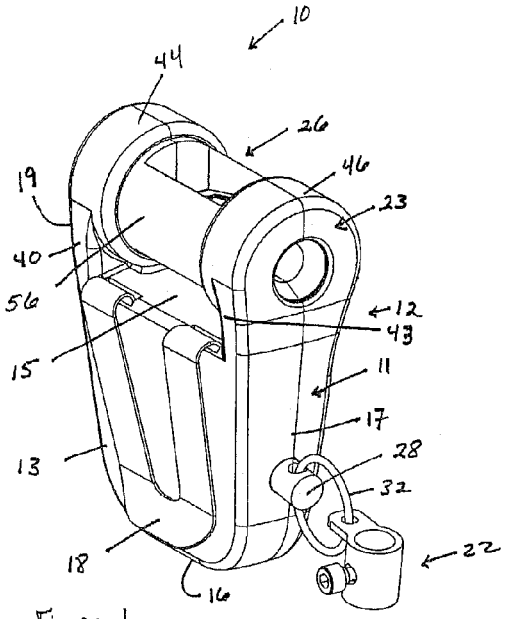
FIG. 1 is a schematic depicting an elevational side view of an exemplary retractable marking device.
Figure 2:
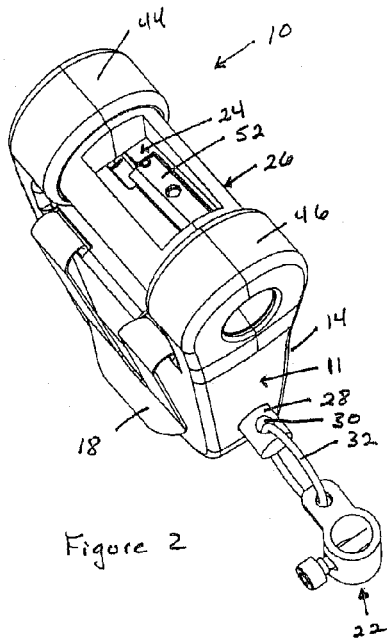
FIG. 2 is a schematic depicting an elevational top view of the retractable marking device depicted in FIG. 1.
Figure 3:
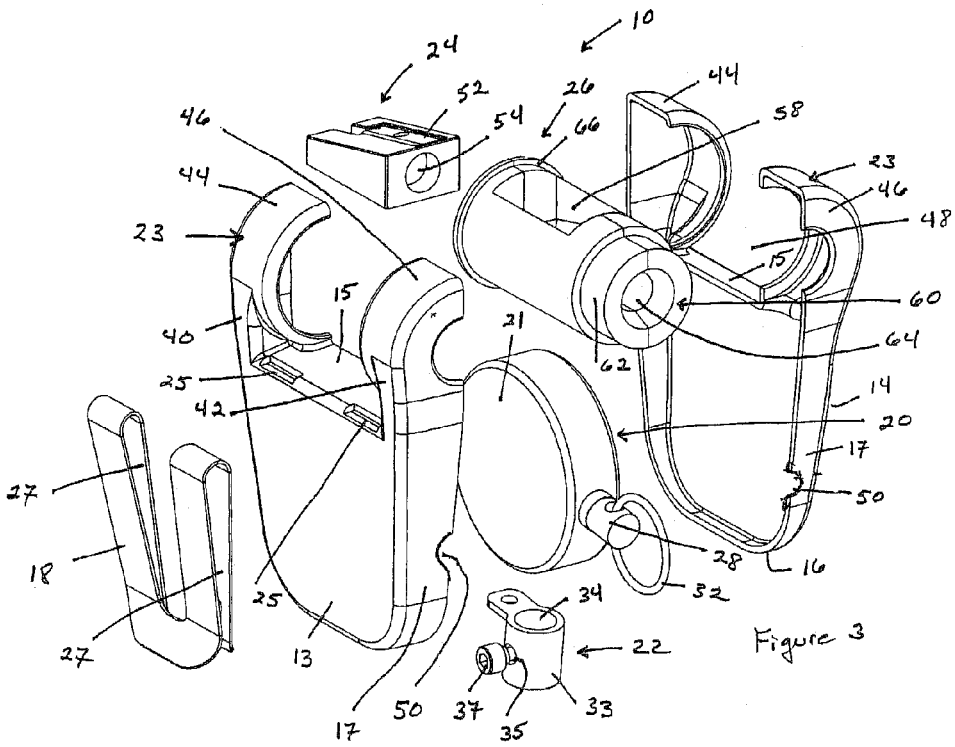
FIG. 3 is a schematic depicting the various components of the retractable marking device depicted in FIGS. 1 and 2.
Figure 4:
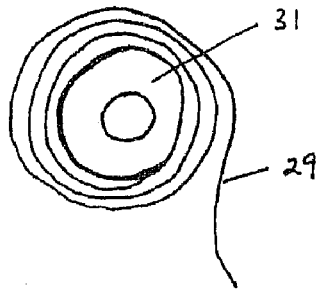
FIG. 4 is a schematic depicting an exemplary reel and coil.

In general, disclosed herein is an inventive retractable marking device which engages with and allows for the continuous extension and retraction of a marking instrument. Although the marking instrument may comprise a wide variety of implements used for writing purposes, exemplary marking instruments include, for example, pencils, pens, chalk, and the like, wherein ⅜th diameter pencil, such as is conventionally used by contractors, is especially preferred. The engagement element preferably allows for the hold of a variety of sized marking instruments thereby extending the applicability of the device. The device is easily attachable to a user's garb or working paraphernalia, such as, for example, a user's belt, pocket, tool belt, tool case, briefcase, and the like, such that the marking instrument is readily at hand when desired. Additionally, the device may further comprise a sharpener, whereby the marking instrument can be sharpened to enhance its function. In this manner, then, the retractable marking device provides a mechanism whereby a marking instrument is readily at hand no matter the location of the user, whereby the writing element is less likely to become lost or disengaged from the device, whereby the device is capable of holding a variety of shaped marking instruments, whereby the marking instrument can be sharpened to improve its writing performance, and whereby the marking instrument can be easily withdrawn and retracted from the device.

Exemplary retractable marking devices of the present invention will be described with reference to the figures. However, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

Referring to FIGS. 1-4, an exemplary retractable marking device 10 comprises a casing 12, a fastener 18, a retractor 20, an engagement element 22, a sharpener 24, and a barrel 26. Each of these is described in turn.

Casing 12 serves to hold fastener 18, retractor 20, and barrel 26. To accomplish this, casing 12 comprises a main body 11 joined to a barrel receiver 23.

Main body 11 comprises a front side 13, a back side 14, a top side 15, a bottom side 16, a proximal lateral side 17, and a distal lateral side 19. At least one of proximal and distal lateral sides 17 and 19 comprises a notch 50, which allows for the protrusion of a braking element 28 of retractor 20, which will be described in greater detail below. Additionally, main body 11 comprises arms 40 and 43 which extend from front side 13 of main body 11, an arm (not shown) directly opposite to arm 40 which extends from back side 14 of main body 11, and an arm (not shown) directly opposite to arm 43 which extends from back side 14 of main body 11. Preferably main body 11 is manufactured from plastic, although a variety of lightweight materials may be used.

Barrel receiver 23 comprises grips 44 and 46, wherein grip 44 extends from arm 40 to the arm directly opposite to arm 40 and grip 46 extends from arm 43 to the arm directly opposite to arm 43. Grips 44 and 46 serve to hold the ends of barrel 26. Barrel receiver 23 further comprise a space 48, which provides room for the placement of the body of barrel 26 and which separate grip 44 from grip 46. Although it is contemplated that grips 44 and 46 may comprise a wide variety of geometrical configurations depending on the geometrical configuration of barrel 26, in the particular embodiment depicted in the figures, each of grips 44 and 46 are rounded to accommodate the tubular ends of barrel 26. Preferably barrel receiver 23 is manufactured from plastic, although a variety of lightweight materials may be used.

Fastener 18, which is located on front side 13 of main body 11 serves to attach device 10 to a user's garb or working paraphernalia. Although shown as a clip, fastener 18 may comprise a wide variety of coupling elements, such as, for example, a clamp, e.g., an alligator clamp, a hook, and the like. Preferably fastener 18 is manufactured from plastic or metal. For the embodiment depicted in the figures, top side 15 of main body 11 comprises a pair of slots 25 through which back panels 27 of fastener 18 are insertable and by which fastener 18 is secured to main body 11.

Retractor 20 comprises a housing 21. Located within housing 21 is a coil 29 wound around a holding reel 31. A first terminal end of coil 29 is anchored to holding reel 31, which allows the first terminal end to stay fixed on holding reel 31 as coil 29 is flexed or retracted. Coil 29 may comprise a chord, linked chain, and the like, and may comprise any length so long as the length allows the coil to extend to a reasonably desired distance when the marking instrument is in use.

Retractor 20 further comprises a latching mechanism for attaching engagement element 22 to retractor 21. In an exemplary embodiment, the latching mechanism comprises braking element 28 in association with a ring 32. Braking element 28 comprises a throughole 30 through which ring 32 is attached. Additionally a second terminal end of coil 29 is attached to braking element 28 such that when ring 32 is pulled away from device 10, coil 29 unwinds around holding reel 31.

In a particularly preferred configuration, engagement element 22 comprises a tubular member 33 that contains a bore 34. Bore 34 facilitates the passage of the marking instrument into engagement element 22. Engagement element 22 further comprises a securing mechanism by which the marking instrument is temporarily fixed to engagement element 22. In an exemplary embodiment, the securing mechanism comprises a threaded hole 35 located through a side surface of member 33 and a threaded bolt 37, wherein threaded bolt 37 fits into threaded hole 35. When threaded bolt 37 is tightened, a portion of bolt 37 protrudes into bore 34 and contacts the marking instrument until the marking instrument is pushed against an interior side wall of member 33, thereby securing the marking instrument to member 33. As bolt 37 in combination with tubular member 33 serves as a clamping mechanism by which to secure the marking instrument to engagement element 22, marking instruments having a variety of diameters may be securely held to engagement element 22.

Additionally, in its preferred configuration, engagement element 22 contains a protrusion 39 with a hole 41 passing through protrusion 39. Protrusion 39 is located at one end of engagement element 22 and facilitates communication of coil 29 to engagement element 22. In its preferred configuration, coil 29 communicates with engagement element 22 through ring 32. Preferably, engagement element 22 is manufactured from metal. However, engagement element 22 may be manufactured from plastic or other similar materials.

As previously stated, device 10 further comprises a sharpener 24 and a barrel 26, wherein barrel 26 is configured to hold sharpener 24 and to be held by grips 44 and 46 of barrel receiver 23. Sharpener 24 may include a conventional pencil sharpener as is depicted in the figures, comprising a blade 52 resting above an internal cavity, wherein the internal cavity is accessible via a hole 54, but may also include variations thereto, and may be specially adapted to the sharpening of other types of marking instruments, i.e., marking instruments other than a pencil.

As depicted in FIGS. 1-4, in an exemplary embodiment, barrel 26 comprises a tubular body 56 comprising an opening 58 into which sharpener 24 is engaged, for example, by frictional or snap fit. Preferably, sharpener 24 is removably engaged with barrel 26 such that sharpener 24 can be replaced when blade 52 has become dulled. Additionally, barrel 26 comprises a receiving element 60 having a rounded outer surface 62, which is engaged by grip 46, and a throughbore 64. Throughbore 64 is aligned with hole 54 of sharpener 24 such that the marking instrument can be sharpened by inserting it through throughbore 64 and hole 54 until it makes proper contact with blade 52. Opposite to receiving element 60 is a rounded end 66 which is secured to casing 12 via grip 44. Preferably, sharpener 24 and barrel 26 are manufactured from plastic or metal, but may also be manufactured from any lightweight, inexpensive material.

Figure 5:
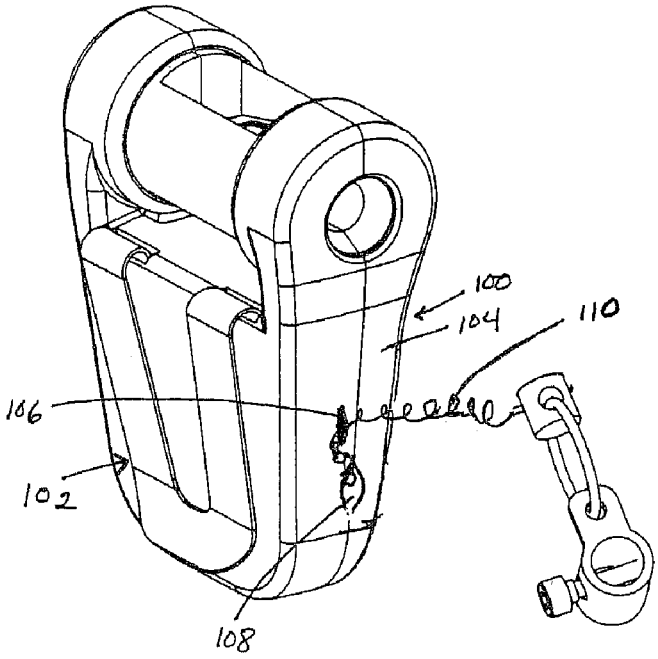
FIG. 5 is a schematic depicting another exemplary retractable marking device.
Figure 6:
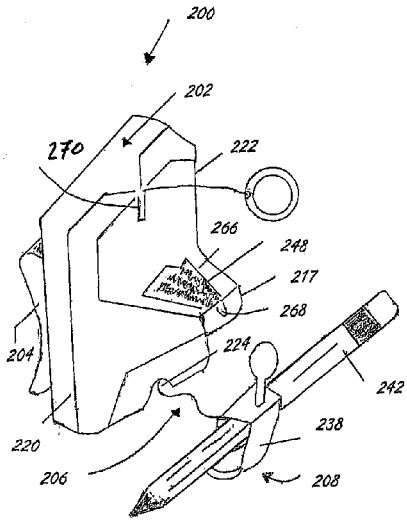
FIG. 6 is a schematic depicting an elevational side view of another exemplary retractable marking device.
Figure 9:
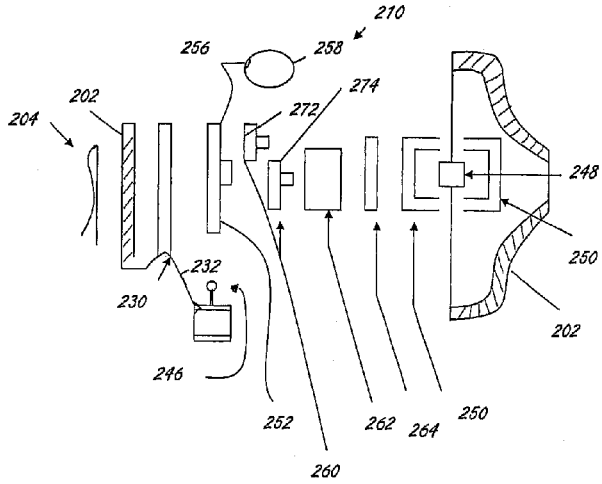
FIG. 9 is a schematic depicting the various components of the retractable marking device depicted in FIGS. 6-8.
Figure 7:
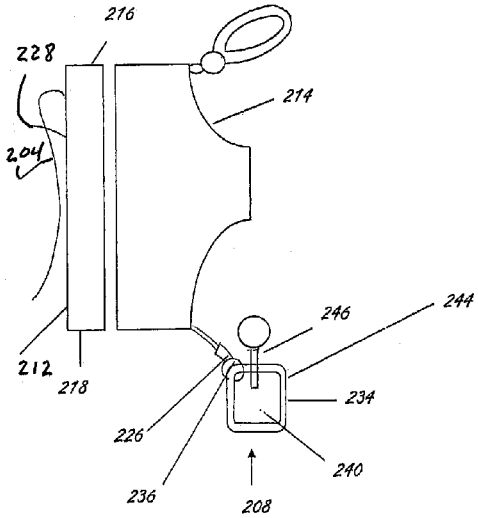
FIG. 7 is a schematic depicting a side view of the retractable marking device depicted in FIG. 6.
Figure 8:
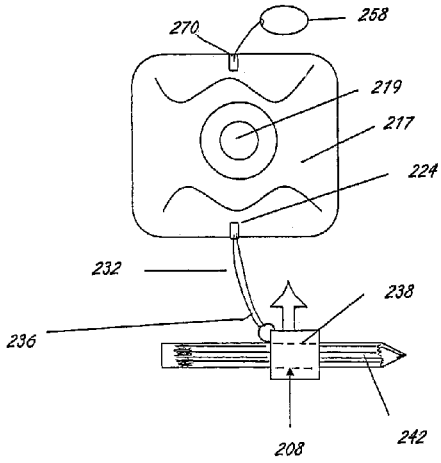
FIG. 8 is a schematic depicting a backside view of the retractable marking device depicted in FIGS. 6 and 7.
Figure 10:
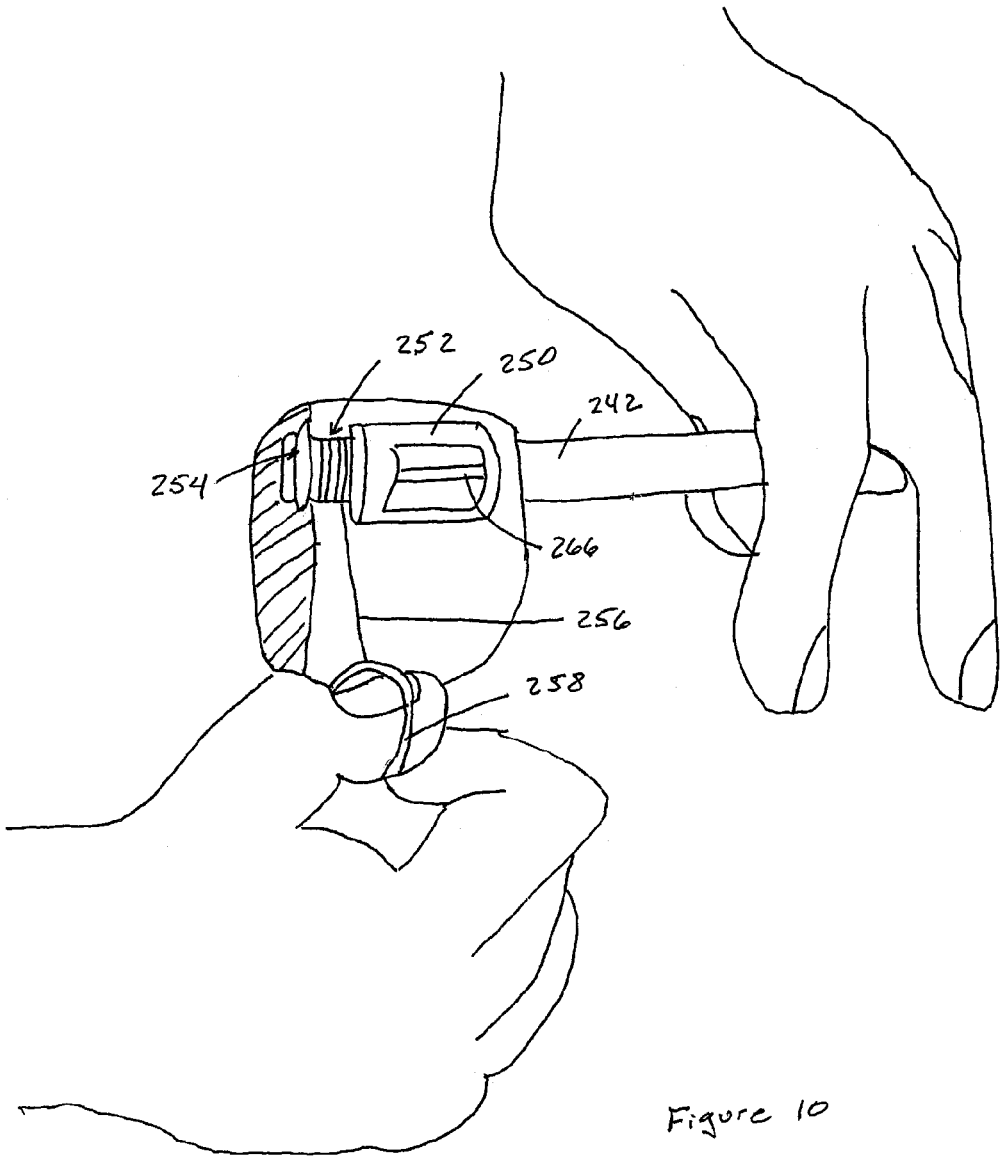
FIG. 10 is a schematic depicting an exemplary use of the retractable marking device depicted in FIGS. 6-9.

Referring to FIG. 5, which depicts another exemplary device, a casing 100 comprising all of the same structural elements as casing 12 further comprises main body 102, which comprises a protrusion 106, which is disposed on a lateral side 104 and located proximate to a notch 108. In this embodiment, the coil of the retractor preferably comprises a linked chain 110, wherein a link from chain 110 fits onto protrusion 106. When the link is latched onto protrusion 106, linked chain 110 is "locked" into place, such that linked chain 110 is prevented from retracting back into main body 102 when linked chain 110 is extended from the reel (not shown). It is noted that protrusion 106 may be adapted to the casing 202 of exemplary retractable marking device 200 to serve the same purpose as discussed with reference to the embodiment depicted in FIG. 5.

In application, then, a user may attach device 10 to the user's garb or working paraphernalia via fastener 18. When the user desires to utilize the marking instrument, he/she simply need pull the marking instrument towards him/her, thereby flexing the coil from the reel such that the marking instrument is extended. Once the user is finished using the marking instrument, he/she need only release the marking instrument or move the marking instrument towards retractor 20 such that the coil rewinds around the reel. For the embodiment depicted in FIG. 5, the user can lock the marking instrument such that it does not recoil back into the main body once the drawing force has been withdrawn. Once the user desires to have the marking instrument back in resting position, the user need only disengage the linked coil from the protrusion and allow the coil to retract back towards the reel of the retractor.

Additionally, in the embodiments depicted in FIGS. 1-5, the marking instrument may be manually sharpened either while attached to the marking device or when separated from the marking device by rotating the marking instrument in the sharpener ensuring that the blade makes contact with the appropriate part of the marking instrument. Also, marking instruments having a variety of diameters may be utilized in the device of the present invention merely be turning the threaded bolt until it clamps down on the marking instrument thereby holding it in place.

Referring to FIGS. 6-10, an exemplary retractable marking device 200 comprises a casing 202, a fastener 204, a retractor 206, an engagement element 208, and a sharpening component 210. Each of these is described in turn.

Casing 202 serves to hold fastener 204, retractor 206, and sharpening component 210. Casing 202 comprises a front side 212, a back side 214, a top side 216, a bottom side 218, a proximal lateral side 220, and a distal lateral side 222. The lower section of back side 214 comprises a notch 224, which allows for the protrusion of a braking element 226 of retractor 206, which will be described in greater detail below. Additionally, back side 216 comprises a protrusion 217 designed to hold a sharpener 248 and a barrel 250 of sharpening component 210. Protrusion 217 comprises an access hole 219 for the insertion of a writing instrument into sharpener 248. Preferably casing 202 is manufactured from plastic, although a variety of lightweight materials may be used.

Fastener 204, which is located on front side 212 of casing 202 serves to attach device 200 to a user's garb or working paraphernalia. Although shown as a clip, fastener 204 may comprise a wide variety of coupling elements, such as, for example, a clamp, e.g., an alligator clamp, a hook, and the like. Preferably fastener 204 is manufactured from plastic or metal. For the embodiment depicted in the figures, top side 216 of casing 202 comprises a pair of slots (not shown) through which a back panel 228 of fastener 204 is insertable and by which fastener 204 is secured to casing 202.

Retractor 206 comprises a holding reel 230 sandwiched between front side 213 and back side 214 of casing 202. Retractor 206 further comprises a coil 232 windable around holding reel 230. A first terminal end of coil 232 is anchored to holding reel 230, which allows the first terminal end to stay fixed on holding reel 230 as coil 232 is flexed or retracted. Coil 232 may comprise a chord, linked chain, and the like, and may comprise any length so long as the length allows the coil to extend to a reasonably desired distance when the marking instrument is in use.

Retractor 206 further comprises a latching mechanism for attaching engagement element 208 to retractor 206. In an exemplary embodiment, the latching mechanism comprises braking element 226 in association with a ring 234. Braking element 226 comprises a throughole 236 through which ring 234 is attached. Additionally a second terminal end of coil 232 is attached to braking element 226 such that when ring 234 is pulled away from device 200, coil 232 unwinds around holding reel 230.

In a particularly preferred configuration, engagement element 208 comprises a tubular member 238 that contains a bore 240. Bore 240 facilitates the passage of a marking instrument 242 into engagement element 208. Engagement element 208 further comprises a securing mechanism by which marking instrument 242 is temporarily fixed to engagement element 208. In an exemplary embodiment, the securing mechanism comprises a threaded hole 244 located through a side surface of member 238 and a threaded bolt 246, wherein threaded bolt 246 fits into threaded hole 244. When threaded bolt 246 is tightened, a portion of threaded bolt 246 protrudes into bore 240 and contacts marking instrument 242 until marking instrument 242 is pushed against an interior side wall of member 238, thereby securing marking instrument 242 to member 238. As threaded bolt 246 in combination with tubular member 238 serves as a clamping mechanism by which to secure marking instrument 242 to engagement element 208, marking instruments having a variety of diameters may be securely held to engagement element 208. Preferably, engagement element 208 is manufactured from metal. However, engagement element 208 may be manufactured from plastic or other similar materials.

As previously stated, device 200 further comprises a sharpening component 210. Sharpening component 210 comprises sharpener 248 encased within barrel 250 such that hole 268 of sharpener 248 is aligned with an opening (not shown) on barrel 250. The sharpening component is designed to allow for the sharpening of a marking instrument via mechanical means as contrasted to the manual sharpening accomplished by manually rotating the marking instrument in the sharpener, such as is accomplished by the inventive device disclosed with reference to FIGS. 1-5. In the exemplary embodiment depicted in FIGS. 6-10, sharpening component 210 functions through the mechanical rotation of barrel 250, which in turn rotates sharpener 248 about the marking instrument, thereby sharpening the marking instrument. Sharpener 248 may include a conventional pencil sharpener as is depicted in the figures, comprising a blade 266 resting above an internal cavity, wherein the internal cavity is accessible via a hole 268, but may also include variations thereto, and may be specially adapted to the sharpening of other types of marking instruments, i.e., marking instruments other than a pencil. In an exemplary embodiment hole 268 is aligned with access hole 219 on casing 202.

The mechanical sharpening of the marking instrument utilizing device 200 is more specifically accomplished through the interplay of various component parts of sharpening component 210 as now described. In addition to barrel 250 and sharpener 248, sharpening component 210 further comprises a drive reel 252, a return spring 254, a coil 256, and a handle 258. Additionally, sharpening component 210 further comprises optional components: a gear train 260, a clutch 262, and a coupling 264.

As depicted in the figures, coil 256, which may comprise string, metal, chord, and the like, is wound around drive reel 252 and a terminal end of coil 256 is fixedly attached to drive wheel 252. The opposite terminal end of coil 256 extends from a notch 270 located on back side 214 of casing 202. Drive reel 252 is in communication with return spring 254.

Coil 256, drive reel 252, and return spring 254 act together to rotate barrel 250, and hence, sharpener 248, within a chamber located within casing 202. More specifically, return spring 254 is connected to drive reel 252 such that when drive reel 252 is turned in a clockwise direction, for example, return spring 254 becomes stressed. The rotational movement of drive reel 252, which causes return spring 254 to become stressed, is induced by extending coil 256, which is wound around drive reel 252, via handle 258 away from drive reel 252. When return spring 254 relaxes, it causes drive reel 252 to rotate in the opposite direction, such as in a counterclockwise direction. The release of extended coil 256 causes return spring 254 to relax and causes extended coil 256 to retract and wind back around drive reel 252.

Barrel 250 is in communication with drive reel 252 such that as drive reel 252 rotates when coil 256 is pulled, barrel 250 rotates as well. Additionally, because sharpener 248 is directly attached to barrel 250, the rotation of barrel 250 necessarily causes sharpener 248 to rotate as well. In an exemplary embodiment, barrel 250 is in direct communication with drive reel 252, i.e., barrel 250 is directly attached to drive reel 252. In this embodiment, when coil 256 is released and retracted back around drive reel 252, barrel 250 also winds in the reverse direction from the direction it wound when coil 256 was extended.

However, in an alternative embodiment, at least one of a coupling 264, a clutch 262, and a gear train 260 may also attach barrel 250 to drive reel 252. Coupling 264 is useful in attaching barrel 250 to either drive reel 252, or when, used, clutch 262 or gear train 260. Coupling 264 serves to fit a variety of typed barrels to an abutting component, such as, the drive reel, clutch, or gear train.

Clutch 262 serves to deflect torque away from barrel 250 such that when coil 256 is retracted back around drive reel 252, barrel 250 and sharpener 248 remain stationary. Accordingly, to accomplish this, clutch 262 disengages from either coupling 264 or, if coupling 264 is not used, from barrel 250. In this manner, then, clutch 262 prevents barrel 250 from rotating with drive reel 252 when coil 256 retracts back into position around drive reel 252.

Gear train 260, which comprises a first gear 272 and a second gear 274, serves to increase the overall torque, thereby decreasing the number of times a user would pull on coil 232 to effectively sharpen the marking instrument. Accordingly, though not required for operation, gear train 260 serves to maximize the efficiency of device 200.

Although not depicted, sharpening component 210 may further comprise a compartment for holding the shavings of the marking instrument resulting from use of sharpener 248. The compartment may be snap fitted onto the bottom of barrel 250. Additionally, the compartment may be removed from device 200 such that the shavings may be readily discarded.

Furthermore, it is contemplated that blade 266 of sharpener 248 may be replaced by conventional means in the event that the blade should become dulled. Alternatively, barrel 250 and sharpener 248 may be removed from device 200 and replaced with a new barrel/sharpener combination once the sharpener becomes dulled.

In an exemplary method of using sharpening component 210, a user inserts marking instrument 242 through access hole 219, hole 268 of sharpener 248, and the opening in barrel 250. The user then pulls coil 232 via handle 258 such that drive reel 252, sharpener 248, and barrel 250 rotate in a first direction. Such rotation of sharpener 248 causes marking instrument 242 to become sharpened. Once the rotation of the various components stops, marking instrument 242 is removed from device 200, and coil 232 is moved back towards drive reel 252 and automatically wound around drive reel 252 through the assistance of return spring 254. The process is simply repeated until marking instrument 242 has a desired sharpness.

Fastener 204, retractor 206, and engagement element 208 may be utilized in the same manner as discussed above in relation to the embodiment depicted in FIGS. 1-5.

Accordingly, the marking device of the present invention provides for the secure grip of a marking instrument coupled with the ready positioning of the device either on or close to a user such that a marking instrument is always readily at hand. Furthermore, once the marking instrument is no longer necessary, the retractable marking device withdraws the marking instrument from a user, thereby keeping it out of the user's way. Also, by positioning a sharpener within the marking device, the device provides a convenient way of ensuring that the marking instrument is ready for use.

As required, detailed embodiments of the present invention have been disclosed herein. However, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

What is claimed is:

1. A retractable marking device comprising:

a casing comprising:

a main body comprising a front side opposite to a back side, a top side opposite to a bottom side, and a distal lateral side opposite to a proximal lateral side, wherein the proximal and distal lateral sides are connected to the front, back, top, and bottom sides to form a hollow interior, and wherein the main body further comprises a first arm extending from a first terminal edge of the front side, a second arm extending from a second terminal edge of the front side, a third arm extending from a first terminal edge of the back side, and a fourth arm extending from a second terminal edge of the back side; and a barrel receiver comprising a plurality of grips fixed to the casing, wherein the plurality of grips comprises a first grip attached to the first and third arms and a second grip attached to the second and fourth arms, and wherein a space is formed between the first and second grips;

a fastener attached to at least one of the front and back sides of the main body, wherein the fastener attaches the device to a user;

a retractor comprising a housing encasing a reel and a coil wound around the reel, wherein the retractor is disposed within the hollow interior;

an engagement element in communication with the coil, wherein the engagement element comprises a bore, and wherein a marking instrument is insertable within the bore;

a barrel held to the barrel receiver via the plurality of grips, wherein the barrel comprises a throughbore transverse to an opening, and a first terminal end opposite to a second terminal end, wherein the throughbore extends to the first terminal end, and wherein the first terminal end is held by the first grip, and the second terminal end is held by the second grip; and a sharpener comprising a blade transverse to a hole, wherein the sharpener is disposed within the opening of the barrel such that the hole of the sharpener is aligned with the throughbore of the barrel.

2. The retractable marking device of claim 1, wherein:

the barrel comprises a tubular body capped by the first terminal end which comprises a rounded receiving element and by the second terminal end which comprises a rounded terminal end; and wherein the first grip comprises a first curved grasping element and the second grip comprises a second curved grasping element, wherein the first curved grasping element attaches the rounded receiving element to the main body, and the second curved grasping element attaches the rounded terminal end to the main body.

3. The retractable marking device of claim 2, wherein:

the retractor further comprises:

a braking element comprising a hole, wherein the braking element lies against the main body when the coil is fully wound around the reel; and a ring disposed through the hole of the braking element; and the main body further comprises a notch through which the braking element and the ring extend.

4. The retractable marking device of claim 3, wherein:

the coil comprises a plurality of links interconnected to form a chain; and the main body further comprises a protrusion located proximate to the notch, wherein one of the links is hooked onto the protrusion to hold the chain in place when the chain is at least partially unwound from the reel.

5. The retractable marking device of claim 4, wherein the engagement element comprises:

a tubular body through which the bore extends;

a hole in the tubular body, wherein the hole is transverse to the bore;

a bolt insertable in the hole, wherein the hole and the bolt secure a variety of sized marking instruments; and a protrusion that extends from a terminal end of the tubular body, wherein the protrusion comprises a hole through which the ring is inserted to secure the engagement element to the retractable marking device.

6. The retractable marking device of claim 5, wherein the sharpener is removable from the barrel.

7. The retractable marking device of claim 6, wherein the sharpener is disposed within the barrel by a snap mechanism or by frictional fit.

8. A retractable marking device comprising:

a casing comprising:

a main body comprising a front side opposite to a back side, a top side opposite to a bottom side, and a distal lateral side opposite to a proximal lateral side, wherein the proximal and distal lateral sides are connected to the front, back, top, and bottom sides to form a hollow interior; and a barrel receiver comprising a plurality of grips fixed to the casing;

a fastener attached to at least one of the front and back sides of the main body, wherein the fastener attaches the device to a user;

a retractor comprising a housing encasing a reel and a coil wound around the reel, wherein the retractor is disposed within the hollow interior, and wherein the retractor comprises:

a braking element comprising a hole, wherein the braking element lies against the main body when the coil is fully wound around the reel; and a ring disposed through the hole of the braking element; and wherein the braking element and the ring extend through a notch located on the main body;

an engagement element in communication with the coil, wherein the engagement element comprises a bores and wherein a marking instrument is insertable within the bore;

a barrel held to the barrel receiver via the plurality of grips, wherein the barrel comprises a throughbore transverse to an opening; and a sharpener comprising a blade transverse to a hole, wherein the sharpener is disposed within the opening of the barrel such that the hole of the sharpener is aligned with the throughbore of the barrel.

9. The retractable marking device of claim 8, wherein:

the coil comprises a plurality of links interconnected to form a chain; and the main body further comprises a protrusion located proximate to the notch, wherein one of the links is hooked onto the protrusion to hold the chain in place when the chain is at least partially unwound from the reel.

10. The retractable marking device of claim 8, wherein the engagement element comprises:

a tubular body through which the bore extends;

a hole in the tubular body, wherein the hole is transverse to the bore;

a bolt insertable in the hole, wherein the hole and the bolt secure a variety of sized marking instruments; and a protrusion that extends from a terminal end of the tubular body, wherein the protrusion comprises a hole through which the ring is inserted to secure the engagement element to the retractable marking device.

11. The retractable marking device of claim 1, wherein the sharpener is removable from the barrel.

12. The retractable marking device of claim 11, wherein the sharpener is disposed within the barrel by a snap mechanism or by frictional fit.

13. A retractable marking device comprising:

a retractor comprising a housing encasing a reel, and further comprising a coil releasably woundable around the reel, wherein the coil comprises a first terminal end attached to the reel and a second terminal end attached to a braking element which rests against the housing when the coil is fully wound around the reel;

a main body enveloping the housing of the retractor, wherein the main body comprises a notch from which the braking element protrudes;

an engagement element comprising a bore through which a marking instrument is engageable, a securing mechanism whereby the marking instrument is releasably secured to the engagement element, and a latching mechanism for connecting the engagement element to the braking element;

a barrel receiver connected to the main body comprising a first grip opposite to a second grip, wherein the first and second grips are separated by a space, and wherein the first grip comprises a first curved grasping element, and the second grip comprises a second curved grasping element;

a barrel fixed to the barrel receiver via the first and second grips, wherein the barrel comprises an opening transverse to a throughbore, and a tubular body capped by a rounded receiving element and by a rounded terminal end, wherein the throughbore of the barrel extends to the rounded receiving element;

wherein the first curved grasping element attaches the rounded receiving element to the main body, the second curved grasping element attaches the rounded terminal end to the main body, and the tubular body fits within the space; and a sharpener that sharpens the marking instrument, wherein the sharpener comprises a blade transverse to a hole, wherein the sharpener is engaged with the opening of the barrel such that the hole of the sharpener is aligned with the throughbore of the barrel.

* * * * *